US005427047A

United States Patent [19]

Woodfin et al.

[11] Patent Number: 5,427,047

[45] Date of Patent: Jun. 27, 1995

[54] TOW ROPE HOLDER

[76] Inventors: Richard Woodfin, 1040 Berrett Dr., Blackfoot, Id. 83221; Brent Young, 2477 N. 725 E., Ogden, Utah 84414

[21] Appl. No.: 178,155

[22] Filed: Jan. 6, 1994

[51] Int. Cl.[6] ..... B63B 21/04

[52] U.S. Cl. ..... 114/253; 114/219

[58] Field of Search ..... 114/242, 219, 343, 364, 114/253; 441/65, 68–72; 24/115 R, 115 K, 129 R, 128, 130, 132 R, 133

[56] References Cited

U.S. PATENT DOCUMENTS

| | | | |
|---|---|---|---|
| 428,391 | 5/1890 | Gesner | 114/218 |
| 2,946,305 | 7/1960 | Hill | 114/235 |
| 2,983,010 | 5/1961 | Huggins | 24/115 K |
| 3,066,328 | 12/1962 | Jones | 9/310 |
| 3,125,060 | 3/1964 | Leonard | 115/6.1 |
| 3,142,075 | 7/1964 | Hill | 9/310 |
| 3,216,031 | 11/1965 | Ingolg, Jr. | 9/310 |
| 3,343,514 | 9/1967 | Brett | 24/115 R |
| 3,889,321 | 6/1975 | Moser | 24/115 K |
| 5,080,620 | 1/1992 | Reden | 441/68 |
| 5,083,955 | 1/1992 | Echols | 441/65 |
| 5,154,655 | 10/1992 | Glydon | 441/75 |
| 5,163,860 | 11/1992 | Clark | 441/65 |

*Primary Examiner*—Ed Swinehart

*Attorney, Agent, or Firm*—Henderson & Sturm

[57] ABSTRACT

The present invention is directed to a connector that includes a base surface having a front end and a back end; an upper surface sloping at one end to connect with the base surface at the front end; and a third surface connected between the back end of base surface and the other upper surface, wherein the third surface has a lower end substantially perpendicular to the back end of the base surface, and an upper end joining the other end of the upper surface, as well as a curved section between the lower end of the third surface and the upper end of the third surface, in addition to a substantially flat section between the lower end of the third surface and the curved section of the third surface, wherein the curved section of the third surface is substantially contiguous with the upper end of the third surface. The connector also has opposite sides connected at a joint between the upper surface and the base surface which includes means for attachment to a support, for example lateral flanges extending outwardly beyond the joint at which each of the opposite sides are connected to the base surface that may be provided with openings for receiving attachment elements which may be received in such openings.

20 Claims, 2 Drawing Sheets

TOW ROPE HOLDER

FIELD OF THE INVENTION

The present invention relates to an aquatic recreational system in which a rider mounts and rides an towing device while being towed in the water behind a tow vehicle. Such aquatic devices include aquatic floation devices, such as a kneeboard on which a rider kneels while being towed. Specifically the present invention is directed to apparatus adapted to be mounted to a kneeboard for temporary attachment to a tow rope handle.

DISCUSSION OF BACKGROUND AND/OR MATERIAL INFORMATION

A number of aquatic floation devices are know that are designed to be towed behind a power boat. In some cases, such aquatic devices are provided with implements for connection in some fashion to the tow rope. Examples of such implements are disclosed in: U.S. Pat. No. 2,946,305 entitled "Water Ski Towing Device" issued to T. G. HILL; U.S. Pat. No. 3,066,328 entitled "Water Skis" issued to B. C. JONES; U.S. Pat. No. 3,125,060 entitled "Water Ski Starting Device" issued to S. J. LEONARD; U.S. Pat. No. 3,142,075 entitled "Water Ski Towing Device" issued to T. G. HILL; U.S. Pat. No. 3,216,031 entitled "Water Surface Devices" issued to W. R. INGOLD JR.; U.S. Pat. No. 5,080,620 entitled "Water Ski Board" issued to S. S. REDEN; U.S. Pat. No. 5,083,955 entitled "Aquatic Recreational Towing Devices" issued to D. G. ECHOLS; U.S. Pat. No. 5,154,655 entitled "Leash Connector & Sports Board Combination" issued to J. A. GLYDON; and U.S. Pat. No. 5,163,860 entitled "Tow System for Water Board" issued to B. CLARK.

SUMMARY OF THE INVENTION

The present invention is directed to a connector that includes a base surface having a front end and a back end; an upper surface sloping at one end to connect with the base surface at said front end; and a third surface connected between the back end of base surface and the other upper surface.

In accordance with the present invention, as described above, the third surface has a lower end substantially perpendicular to the back end of the base surface, and an upper end joining the other end of the upper surface, as well as a curved section between the lower end of the third surface and the upper end of the third surface, in addition to a substantially flat section between the lower end of the third surface and the curved section of the third surface, wherein the curved section of the third surface is substantially contiguous with the upper end of the third surface.

The connector of the present invention, as described above, also has opposite sides connected at a joint between the upper surface and the base surface which includes means for attachment to a support, and lateral flanges extending outwardly beyond the joint at which each of the opposite sides are connected to the base surface, wherein the means for attachment to the support comprises these lateral flanges. The lateral flanges preferably are provided with openings for receiving attachment elements which may be received in said openings, which preferably are screws, by which the support is attached to the base surface.

The present invention is also directed to an apparatus or device, such as the previously described connector, that is adapted to be mounted to aquatic floatation equipment for attaching to a tow rope handle.

More specifically, the present invention is directed to an aquatic apparatus that includes: a floatation device, and a connector attached to the floatation device, wherein the connector includes: a base surface having a front end and a back end; an upper surface sloping at one end to connect with the base surface at the front end; and a third surface having: a lower end connected at a joint to the back end of the base surface, an upper end joining the other end of the upper surface; a curved section between the lower end of the third surface and the upper end of the third surface, and a substantially flat section between the lower end of the third surface and the curved section of the third surface, wherein the curved section of the third surface is substantially contiguous with the upper end of the third surface, and wherein the third surface is connected between the back end of the base surface and the another end of the upper surface; opposite sides connected at a joint between the upper surface and the base surface, wherein the base surface includes lateral flanges extending outwardly beyond the joint between the upper surface and the base surface at which joint each of the opposite sides are connected to the base surface, and wherein the lateral flanges comprise openings for receiving attachment elements; and attachment elements received in the openings. Preferably, the lower end of the third surface and the back end of the base surface form the joint between the lower end of the third surface and the back end of the base surface at an angle of about 90°.

In accordance with the present invention, as described above, the attachment elements are screws, that attach a support to the base surface, preferably wherein the support comprises mounting strips.

DETAILED DESCRIPTION

Figure 1:
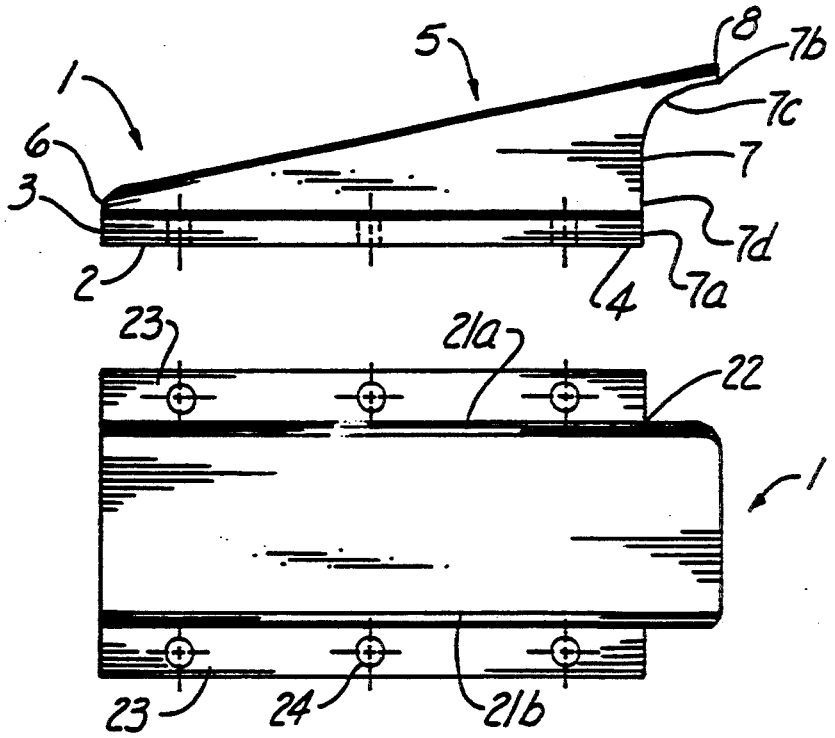
FIG. 1 illustrates the tow rope holder of the present invention.

There are many items on the market to aid people while getting up on water skis; however, to our knowledge we have found nothing on the market for kneeboards.

A kneeboard is a planing device which is towed behind a moving boat.

The kneeboard is the only floatation device designed to ride in a kneeling position. All other devices are designed to be ridden in a standing position. Kneeboards allow one to perform maneuvers different from other floatation devices. On the kneeboard it is important to strap oneself in after the board is planing above the water. However, one cannot be in this position when starting out.

A kneeboard was initially considered as an alternative to water skis which could be enjoyed without significant training or experience. Although it may seem easy to hold a tow rope handle and pull oneself up on a kneeboard to be pulled across the water, in many instances it is difficult for a rider to get from a lying position in the water to the kneeling position while the kneeboard is being pulled. Therefore, many kneeboard users have difficulty in performing the maneuvers which are necessary in order to attain the kneeling position as the kneeboard is towed. The tow rope holder of the present invention makes it easier to attain this position.

As previously mentioned, a problem or drawback of a kneeboard is getting up from a lying position to a kneeling position while being pulled through the water. The tow rope holder of the present invention solves this problem by cradling the towing rope handle thereby freeing the hands of the rider to balance the kneeboard and pull the body of the rider up to a kneeling position.

The tow rope holder of the present invention is also advantageous in allowing small children or others who do not have the strength to hold the towing rope and maneuver the kneeboard to get up to a kneeling position for the ride. Thus, the chances of a novice being able to get up on the kneeboard the first time without having any experience or practice are improved.

Accordingly, the tow rope holder of the present invention is particularly suitable for use on kneeboards operated, for example, by resorts and kneeboard rental businesses to help promote the rentals of kneeboards because many people who rent kneeboards are beginners or novices to the sport.

The tow rope holder of the present invention is also particularly suitable for use by water sport schools to assist beginners to get up on the kneeboard without encountering the previously mentioned difficulties.

Thus, the tow rope holder of the present invention complements the kneeboard and would give assurance to sports persons concerned about the difficulty of getting up on the kneeboard.

Unlike a ski board on which a rider rides while standing with feet in stirrups, the kneeboard is ridden while the rider kneels on the board. To maintain the rider on board the kneeboard, and to permit the maneuvering of the board without separating the rider from the board, a strap is utilized which passes over the thighs of the rider to aid in preventing his separation from the board. This strap must be positioned and adjusted after the kneeboard has been drawn into motion by movement of the towing boat. To initiate the ride on a kneeboard, the rider holds the handle of the tow rope with one or both hands while lying generally prone on the kneeboard, holding the kneeboard with one or both hands. As the two vehicles begin to move, the rider must maintain hold of both the tow rope handle and the kneeboard. As the kneeboard begins to plane, the rider positions himself on his knees, atop the board and adjusts the strap across his thighs to maintain himself in contact with the board, while holding on to the handle of the tow rope. Eventually, with straps secure, the rider signals the tow vehicle to accelerate. As can be appreciated, the necessity to hold on to the tow rope handle while positioning oneself on the towing device can present a difficult challenge to persons attempting to ride a kneeboard.

It is the intent of the present invention to provide improvements in such aquatic recreational devices as to minimize such difficulties and to allow a rider to more readily initiate and complete the previously described maneuvers necessary for riding a kneeboard.

The tow rope holder of the present invention is also advantageous in minimizing the stress encountered by a rider attempting to hold a tow rope handle against the force of a moving tow vehicle while maneuvering an aquatic device into position to initiate a ride thereon. This is done by transferring the initial towing forces directly to the towing device thereby eliminating stress induced in the hands and arms of the rider as the ride begins.

The tow rope holder of the present invention is also advantageous in allowing a person who experiences fatigue to replace the rope in the tow rope holder of the invention in order to rest a few minutes or, if the rider finds his body is not in a proper position, the rope can be replaced in the tow rope holder of the invention to allow the rider readjust the body.

As shown in FIG. 1, the tow rope holder of the present invention, also described herein as a "connector", is described in more detail hereinbelow.

The connector 1 includes a base surface 2 having a front end 3 and a back end 4; an upper surface 5 sloping at one end 6 to connect with the base surface at the front end; and a third surface connected between the back end 4 of base surface 2 and another upper surface 8.

The third surface 7 has a lower end 7*a* which is preferably substantially perpendicular to the back end 4 of the base surface 2, and an upper end 7*b* joining the other end of the upper surface 8.

The third surface includes a curved section 7*c* between the lower end of the third surface and the upper end of the third surface, in addition to a substantially flat section 7*d* between the lower end of the third surface and the curved section of the third surface. As shown, the curved section of the third surface is substantially contiguous with the upper end of the third surface.

The connector of the present invention, as described above, also has opposite sides 21 connected at a joint 22 between the upper surface and the base surface which includes means for attachment to a support which are preferably in the form of lateral flanges 23 extending outwardly beyond the joint at which each of the opposite sides are connected to the base surface. The lateral flanges 23 preferably are provided with openings 24 for receiving attachment elements, such as screws (not shown), by which the support is attached to the base surface.

The tow rope holder is preferably composed of nylon and plastic mixed products.

The tow rope holder of the present invention is preferably 3 inches wide, 5 inches long, and a ½ inch high at the point sloping up to 1.75 inches to a hook shaped portion. The tow rope holder of the present invention is preferably attached to the kneeboard with 6 screws, 3 screws on each side of the hook. The tow rope holder of the present invention is preferably centered on the kneeboard about 1.5 inches from the point of the kneeboard. Attaching the tow rope holder of the present invention with screws allows for a margin of error and also for the removal of the tow rope holder of the present invention if so desired at a later date.

Placement of the tow rope holder of the present invention on the kneeboard from the center point the kneeboard, is preferably about 1.5 inches down from the point, not to exceed 2 inches. Placement is very important to allow the board to plane as soon as possible. Placing the tow rope holder too far back causes the kneeboard to nose dive into the water thus causing the rider to fall off.

Figure 2:
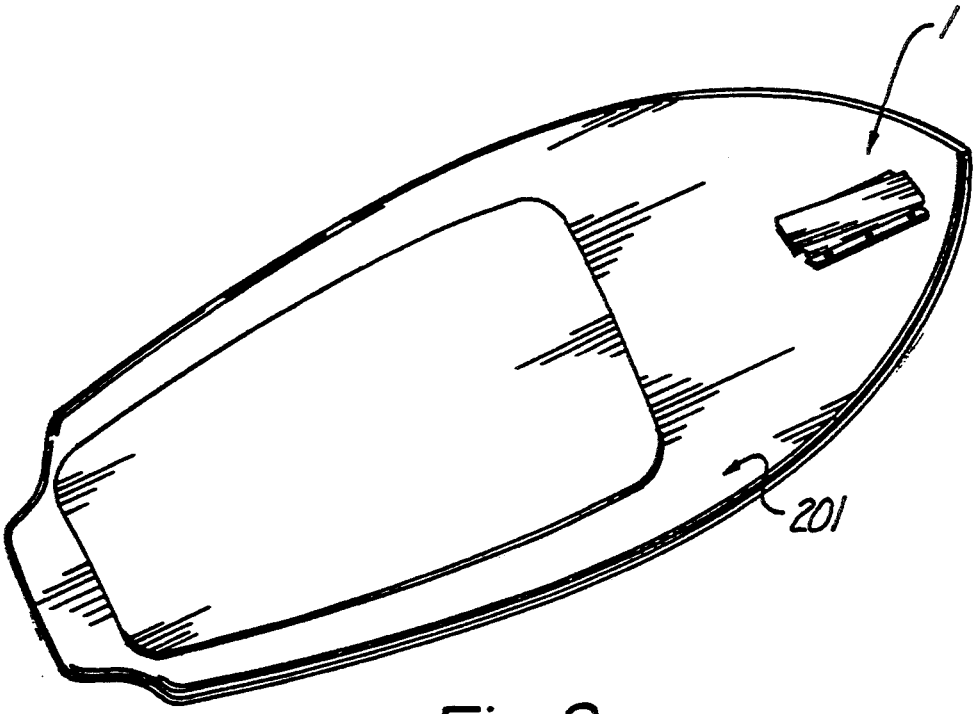
FIG. 2 illustrates the tow rope holder of the present invention mounted to a kneeboard in accordance with the present invention.

Referring now to FIG. 2, the connector 1 or tow rope holder of the present invention is shown mounted to a knee board 201 as the support therefor.

Figure 3:
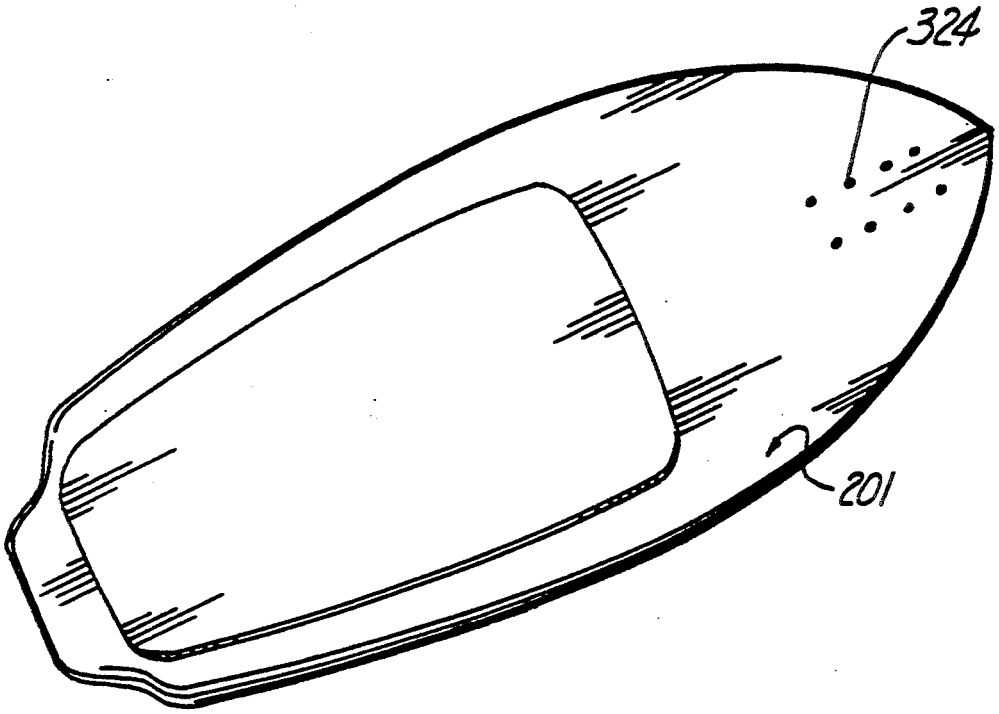
FIG. 3 shows a kneeboard provided with openings for receiving attachment elements for attaching the tow rope holder of the present invention to a kneeboard.

In FIG. 3, a kneeboard 201 is shown which has been modified with a predetermined number of openings or orifices 324 that may be drilled or otherwise formed directly in the body of the kneeboard for receiving attachment elements, such as screws or other suitable fasteners, for attaching the tow rope holder 1 to the kneeboard 201. The number of openings or orifices 324 should at least equal the number of openings 24 in lateral flange 23 of connector 1. However, a greater number of openings 24 may be provided so as to permit adjustment of the placement of the connector 1 on the kneeboard depending on the size of the user.

Figure 4:
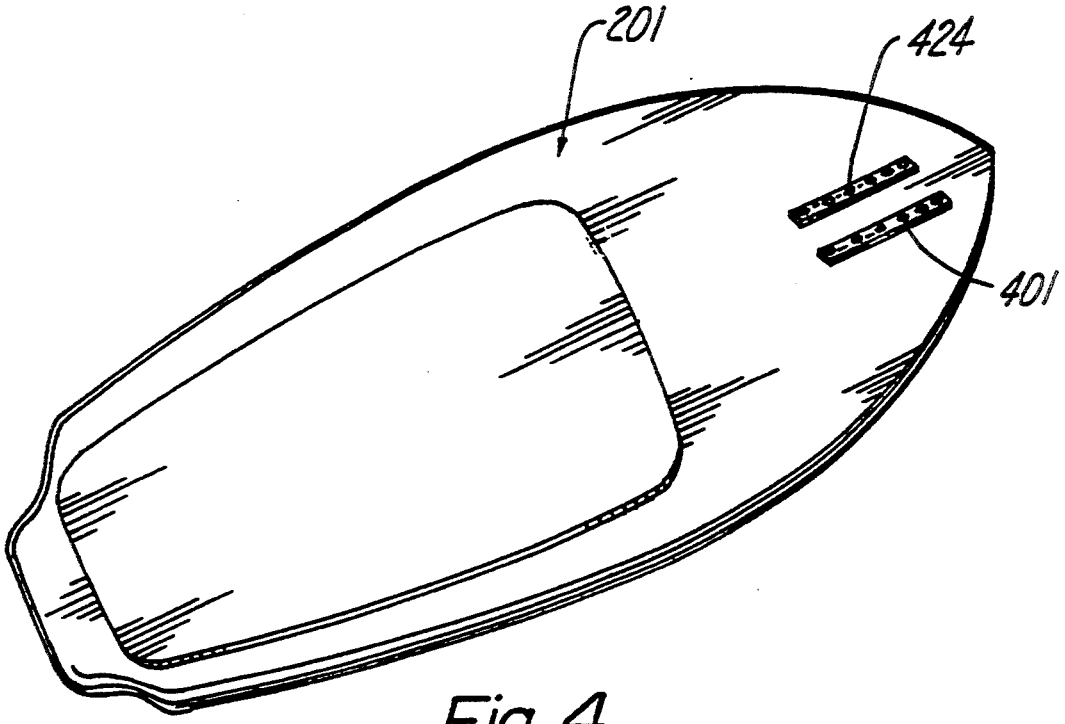
FIG. 4 shows a kneeboard provided with mounting strips having openings for receiving attachment elements for attaching the tow rope holder of the present invention to a kneeboard.

In FIG. 4, a kneeboard 201 provided with mounting strips or rails 401 is illustrated. In this embodiment, openings or orifices 424 for receiving the attachment elements are provided in the mounting strips rather than directly in the kneeboard. The mounting strips 401 are preferably fixed to the surface of the kneeboard using a suitable means for this purpose, preferably an adhesive that effectively secures the mounting strips to the surface of the kneeboard. The mounting strips secured to the surface of the kneeboard are advantageous in that doing so eliminates drilling holes directly into the kneeboard itself. Accordingly, the mounting strips 401 and the tow rope holder of the present invention may be removed from the kneeboard, and reinstalled on a different kneeboard if so desired without permanent alteration of the structure of the kneeboard. Related to this, the kneeboard to which the tow rope holder of the present invention was initially attached would not be permanently marred by open or filled-in orifices that would otherwise be visible after the removal of the tow rope holder.

The design of the tow rope holder of the present invention is advantageous in a number of respects. For example, the rider can use both hands any time to grasp the tow rope. Flush mounting the tow rope holder of the present invention to have a 90° joint between the tow rope holder of the present invention and the kneeboard is important for ease in removing and returning the rope to the tow rope holder of the present invention. The tow rope holder of the present invention does not detract from any use of the kneeboard. The materials used for construction can withstand the affects of UV rays, water (salt & fresh), and abuse. The materials preferred for use in manufacturing the tow rope holder of the present invention is Durethane 30% glass filled nylon available from Miles Manufacturer. The surface area is designed to accommodate existing kneeboards or new kneeboards and to displace pulling stress over total surface of the tow rope holder of the present invention.

Although described herein for use with a kneeboard, the tow rope holder of the present invention may be used on any aquatic planing device where the rider stays in a seated or kneeling position on the device.

What is claimed is:

1. A connector comprising:

a) a base surface having a front end, a back end, and a substantially planar bottom;

b) an upper substantially planar surface sloping at one end to connect with said base surface at said front end and extending rearwardly beyond said back end of said base surface; and c) a third surface connected between said back end of said base surface and another end of said upper surface, said third surface having a lower end substantially perpendicular to said back end of said base surface, and an upper end joining said another end of said upper surface

2. The connector of claim 1, wherein said third surface comprises a curved section between said lower end of said third surface and said upper end of said third surface.

3. The connector of claim 2, wherein said third surface comprises a substantially flat section between said lower end of said third surface and said curved section of said third surface.

4. The connector of claim 3, wherein said curved section of said third surface is substantially contiguous with said upper end of said third surface.

5. The connector of claim 1, comprising opposite sides connected at a joint between said upper surface and said base surface.

6. The connector of claim 5, wherein said base surface comprises means for attachment to a support.

7. The connector of claim 6, wherein said base surface comprises lateral flanges extending outwardly beyond said joint at which each of said opposite sides are connected to said base surface, and said means for attachment to a support comprises said lateral flanges.

8. The connector of claim 7, wherein said lateral flanges comprise openings for receiving attachment elements.

9. The connector of claim 8, further comprising attachment elements received in said openings.

10. The connector of claim 9, wherein said attachment elements are screws.

11. The connector of claim 10, further comprising a support attached to said base surface by said screws.

12. The connector of claim 11, wherein said support comprises mounting strips comprising orifices for receiving said screws and attaching said support to said connector.

13. An aquatic apparatus comprising:

A) a floatation device; and

B) a connector attached to said floatation device, said connector comprising:

a) a base surface having a front end and a back end;

b) an upper substantially planar surface sloping at one end to connect with said base surface at said front end and extending rearwardly beyond said back end of said base surface at another end;

c) a third surface having:

i) a lower end connected at a joint to said back end of said base surface, ii) an upper end joining said another end of said upper substantially planar surface, iii) a curved section between said lower end of said third surface and said upper end of said third surface, and iv) a substantially flat section between said lower end of said third surface and said curved section of said third surface, wherein said curved section of said third surface is substantially contiguous with said upper end of said third surface, and wherein said third surface is connected between said back end of said base surface and said another end of said upper surface;

d) opposite sides connected at a joint between said upper surface and said base surface, wherein said base surface comprises lateral flanges extending outwardly beyond said joint between said upper surface and said base surface at which joint each of said opposite sides are connected to said base surface, and wherein said lateral flanges comprise openings for receiving attachment elements; and e) attachment elements received in said openings.

14. The aquatic apparatus of claim 13, wherein said lower end of said third surface and said back end of said base surface form said joint between said lower end of said third surface and said back end of said base surface at an angle of about 90°.

15. The aquatic apparatus of claim 13, wherein said attachment elements are screws.

16. The aquatic apparatus of claim 15, further comprising a support attached to said base surface by said screws.

17. The aquatic apparatus of claim 16, wherein said support comprises mounting strips.

18. The aquatic apparatus of claim 13, wherein said flotation device comprises a kneeboard.

19. An aquatic apparatus comprising:

A) a floatation device; and

B) a connector attached to said floatation device, said connector comprising:

a) a base surface having a front end and a back end;

b) an upper substantially planar surface sloping at one end to connect with said base surface at said front end and extending rearwardly beyond said back end of said base surface at another end;

c) a third surface having:

i) a lower end connected to said back end of said base surface, ii) an upper end joining said another end of said upper substantially planar surface; and d) opposite sides between said upper substantially planar surface and said base surface.

20. The aquatic apparatus of claim 19, wherein said floatation device comprises a kneeboard.

* * * * *